United States Patent [19]

Hashimoto

[11] Patent Number: 4,968,276

[45] Date of Patent: Nov. 6, 1990

[54] COWLING FOR OUTBOARD UNIT

[75] Inventor: Gaku Hashimoto, Hamamatsu, Japan

[73] Assignee: Sanshin Kogyo Kabushiki Kaisha, Hamamatsu, Japan

[21] Appl. No.: 342,575

[22] Filed: Apr. 24, 1989

[30] Foreign Application Priority Data

Apr. 25, 1988 [JP] Japan ..... 63-101690

[51] Int. Cl.[5] ..... B63H 21/26

[52] U.S. Cl. ..... 440/77; 440/900; 123/195 P

[58] Field of Search ..... 440/900, 76, 77, 88; 181/214, 229, 282; 123/195 P

[56] References Cited

U.S. PATENT DOCUMENTS 2,501,470 3/1950 Krueger et al. ..... 440/77

3,610,198 10/1971 Alexandrowicz ..... 440/77

4,721,485 1/1988 Suzuki ..... 123/195 P X

FOREIGN PATENT DOCUMENTS 120598 7/1984 Japan ..... 440/77

*Primary Examiner*—Joseph F. Peters, Jr.

*Assistant Examiner*—Edwin L. Swinehart

*Attorney, Agent, or Firm*—Ernest A. Beutler

[57] ABSTRACT

A cowling assembly for an outboard unit wherein a first cowling assembly defines a cavity in which the powering internal combustion engine is contained and which has a top surface, a second cowling assembly having a top surface is affixed to this first cowling assembly and interengaging portions between the two top surfaces ridigify the top surface of the second cowling assembly without adding significantly to the weight.

4 Claims, 3 Drawing Sheets

COWLING FOR OUTBOARD UNIT

BACKGROUND OF THE INVENTION

This invention relates to a cowling for an outboard unit and more particularly to an improved, lightweight and yet rigid protective cowling for such outboard units.

It is well known that an outboard motor includes a power head that consists of a powering internal combustion engine and a surrounding protective cowling. The protective cowling is normally formed from a lightweight, thin wall plastic material. There are times, however, when it may be desirable to have the strength of the protective cowling be relatively high so that it can carry a considerable load. For example, in some instances, it may be desirable for the operator to stand upon the protective cowling of the power head, for example, for entrance or exit to or from the associated watercraft. The protective cowlings heretofore provided, however, have not had sufficient strength for this purpose or, alternatively, if they have been strong enough, they have been unduly heavy.

It is, therefore, a principal object of this invention to provide an improved, lightweight protective cowling for an outboard unit.

It is a further object of this invention to provide a lightweight protective cowling for an outboard motor that has sufficient rigidity so that an operator can stand on it without damaging it.

SUMMARY OF THE INVENTION

This invention is adapted to be embodied in a protective cowling arrangement for an outboard motor for containing a powering internal combustion engine. In accordance with the invention, the protective cowling is comprised of a cowling assembly that encircles and encloses the associated internal combustion engine and which has an upper surface. A further cowling assembly is affixed to the first mentioned cowling assembly and extends across this upper surface. The upper surfaces of the two cowling assemblies have interengaging portions so as to serve to rigidify the construction without increasing its weight.

DETAILED DESCRIPTION OF PREFERRED EMBODIMENT

Figure 1:
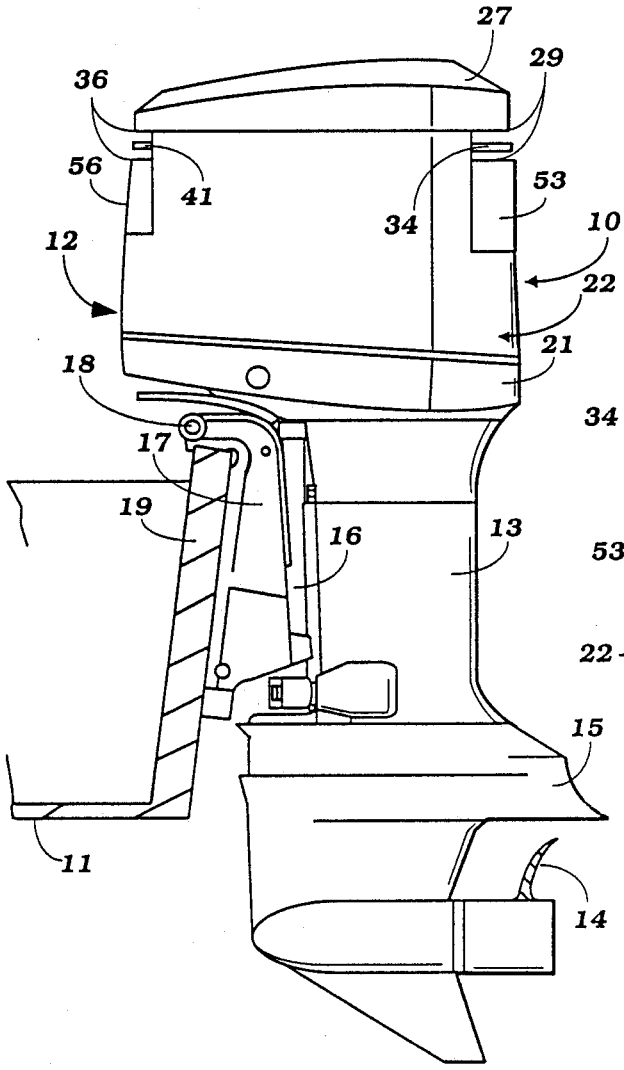
FIG. 1 is a side elevational view of an outboard motor constructed in accordance with an embodiment of the invention.
Figure 2:
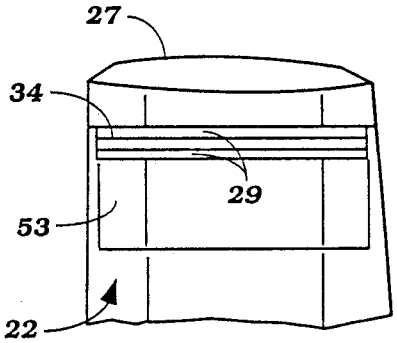
FIG. 2 is a partial rear elevational view of the power head of the outboard motor.

Referring first to FIG. 1, an outboard motor constructed in accordance with an embodiment of the invention is identified generally by the reference numeral 10 and is shown attached to an associated watercraft 11. The outboard motor 10 includes a power head, indicated generally by the reference numeral 12, that contains an internal combustion engine and which is surrounded by a protective cowling and air inlet device constructed in accordance with an embodiment of the invention. The internal combustion engine (which is not shown in any detail in the figures and which may be of any known type) drives an output shaft which, in turn, drives a drive shaft that is journaled for rotation within a drive shaft housing 13 that depends from the power head 12. This drive shaft (not shown) drives a propeller 14 of a lower unit 15 by means of a conventional forward, reverse transmission (not shown).

A steering shaft is affixed to the drive shaft housing 13 in a known manner and is supported for steering movement about a generally vertically extending steering axis within a swivel bracket assembly 16. The swivel bracket assembly 16 is, in turn, pivotally connected to a clamping bracket 17 by means of a pivot pin 18 for tilt and trim movement of the outboard motor 10. The clamping bracket 17 includes means for affixing the outboard motor 10 to a transom 19 of the watercraft 11. The construction of the outboard motor 10 as thus far described may be considered to be conventional and, for that reason, those components which are not illustrated and which have not been described in any more detail may take the form of any of the known components used in this field.

Figure 3:
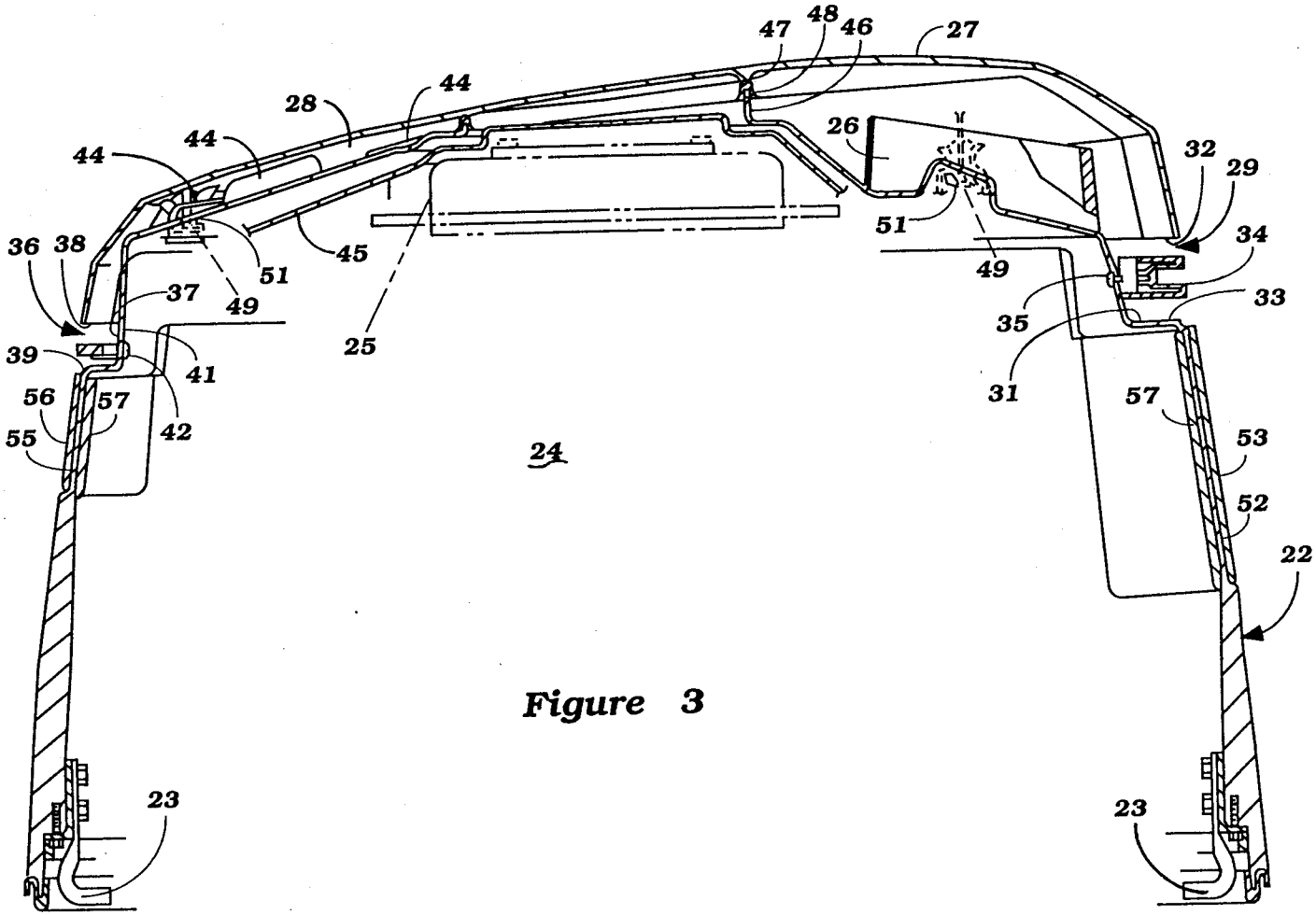
FIG. 3 is an enlarged cross-sectional view taken along a plane extending parallel to the plane of FIG. 1 and shows components of the protective cowling.

Referring now in detail to the remaining figures (FIGS. 2 through 5), the protective cowling of the power head 12 is comprised of a first cowling assembly that includes a tray 21 that is affixed to the lower end of the internal combustion engine and a top cover, indicated generally by the reference numeral 22 and formed from a lightweight plastic material. The top cover 22 has a generally inverted cup shape and carries a pair of latch keepers 23 (FIG. 3) that are formed at the lower end thereof for cooperation with releasable latch mechanisms (not shown) carried by the tray 21 for detachably affixing the top cover 22 and tray 21 to each other. When so affixed, this first cowling assembly defines a cavity 24 in which the internal combustion engine, which appears only partially in FIG. 3 wherein its flywheel 25 is depicted in phantom, is contained.

The engine contained within the cavity 24 obviously includes an induction system and air must be applied to this induction system through a suitable inlet since the first cowling assembly generally fully encloses the internal combustion engine. There are, therefore, formed a pair of upwardly opening air inlet means or openings 25 in the upper rear surface of the top cowling member 22. The air inlet openings 25 are spaced relative to each other but are generally rearwardly positioned. The air inlet means 25 have sufficient flow area so as to adequately serve the induction system needs of the internal combustion engine of the power head 12.

A second cowling assembly, comprised of a single cowling member 27 and also formed from a lightweight plastic material, is affixed, in a manner to be described, across the upper surface of the top portion of the top cowling member 22 of the first cowling assembly so as to prevent articles from falling directly into the cavity 24 through the air inlet openings 25. There is, however, defined a cavity 28 between the cowling assembly 27 and top cover member 22 so as to afford adequate air flow into the air inlet openings 25.

In order to permit air to flow into the cavity 28, there is provided a rearwardly facing air inlet opening, indicated generally by the reference numeral 29. The inlet opening 29 is formed by a recess 31 or indentation in the top cowling member 22 of the first cowling assembly. A rear peripheral flange 32 of the second cowling assembly 27 is spaced upwardly from an upwardly facing shoulder 33 formed by the indentation 31 so as to afford an air inlet passage. A baffle plate 34 is affixed across a portion of the opening 29 and is held to the top cowling member 2 by spaced fasteners 35 so as to afford adequate air flow into the induction system from the rear.

In addition, there is provided a forwardly facing air inlet opening 36 which, like the rear inlet opening 29, is formed by an indentation 37 of the top cowling member 22. This opening 36 is completed by means of a lower peripheral flange 38 of the cowling assembly 27 that is spaced from the upwardly facing shoulder 39 formed by the indentation 37. A further baffle plate 41 extends across the opening 36 and is held in place by spaced fasteners 42 so as to prevent large foreign objects from entering into the cavity 28.

Because the inlet opening 37 is formed downwardly, there is a tortuous air flow path from the inlet opening 36 to the air inlet openings 25 of the first cowling assembly so as to resist the likelihood that water can enter into the cavity 24. In order to further provide against the passage of water into the air inlet openings 26, there are formed a plurality of baffle pairs 43 each of which is comprised of a pair of angularly related baffles 44. The baffles 44 are disposed at an angle so as to further create a tortuous air flow path and to separate any water from the air that may flow in through the forward facing opening 36. In addition, the baffles 44 are angled in such a way that any sound waves emanating into the cavity 28 from the air inlet openings 26 will be reflected back away from the front of the outboard motor as shown by the arrow A in FIG. 5 so as to insure against the emanation of noises from the forward facing air inlet 36.

Figure 5:
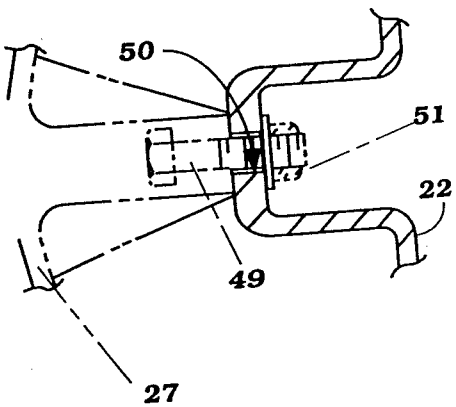
FIG. 5 is an enlarged cross-sectional view taken along the line 5—5 of FIG. 4.
Figure 4:
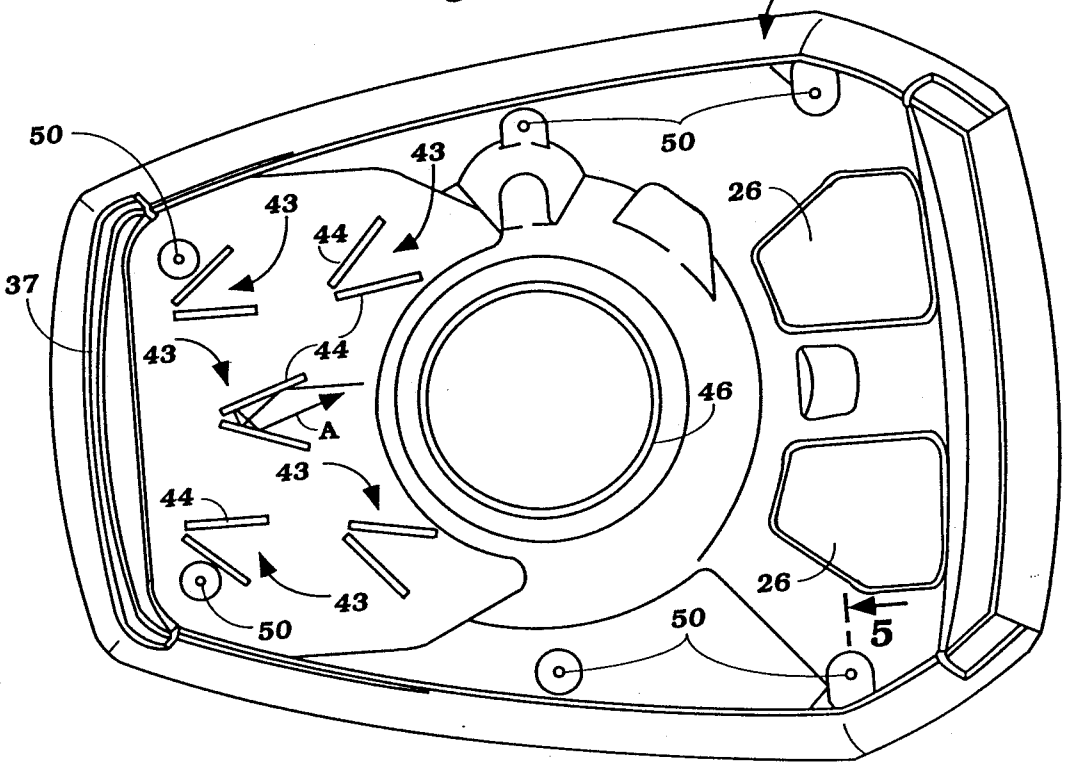
FIG. 4 is an enlarged top plan view of the first cowling assembly with the second cowling assembly removed.

It should be noted that there is provided an internal baffle plate 45 that is affixed to the internal combustion engine and which overlies the flywheel 25. There is provided a raised peripheral flange 46 at the central portion of the top cowling 22 that is engaged by a corresponding flange 47 of the second cowling assembly 27 with a sealing gasket 48 being positioned therebetween. In addition, the cowling assembly 27 is held to the top cowling member 22 by means of a plurality of bosses formed on the cowling assembly 27 in which are molded bolts or studs 49 so as to accommodate attachment by means of nuts 51 (FIG. 5). As a result of this interaction between the top cowling member 22 and the second cowling assembly 27, the top portion of the protective cowling assembly is quite rigid and a person can stand on it without damaging it.

The area immediate beneath the rearwardly facing inlet opening 29 is formed with a reduced thickness section 52 to which a name plate or the like 53 may be attached in any known manner. An elastomeric pad 57 is affixed across the rear face of the thin section 52 for sound deadening. In a like manner, there is provided a reduced thickness section 55 below the forwardly facing opening 36 to which a name plate or the like 56 may be affixed in a suitable manner. A further sound deadening pad 57 is affixed to the rear of this thin section 55 for sound deadening.

It should be readily apparent from the foregoing description that the described protective cowling has extremely high rigidity particularly at its upper surface so that it can bear the weight of an operator and yet it has light weight. Although a embodiment of the invention has been illustrated and described, various changes and modifications may be made without departing from the spirit and scope of the invention, as defined by the appended claims.

I claim:

1. A protective cowling for the power head of an outboard motor comprised of a powering internal combustion engine, said protective cowling comprising a first cowling assembly having a generally inverted cup shape enclosing said engine and defining a cavity in which said engine is positioned, said first cowling assembly having a top surface, a second cowling assembly having a generally inverted cup shape affixed to said first cowling assembly and having a top surface overlying and substantially coextensive with said top surface of said first cowling assembly and thus enclosing and concealing said top surface of said first cowling assembly, said top surfaces of said first and said second cowling assemblies having interengaging portions for rigidifying the top surface of said second cowling assembly without adding substantially to the weight of the entire cowling assembly.

2. A protective cowling as set forth in claim 1 wherein the interengaging portions comprise a raised circular flange on the top surface of the first cowling assembly and engaged with a complimentary portion of the second cowling assembly.

3. A protective cowling as set forth in claim 1 wherein the interengaging portions comprise embossments formed on the second cowling portions and containing threaded fastening means for affixing the cowling assemblies to each other.

4. A protective cowling as set forth in claim 3 wherein the interengaging portions further comprise a raised circular flange on the top surface of the first cowling assembly and engaged with a complimentary portion of the second cowling assembly.

* * * * *